US005445545A

United States Patent [19]

Draper

[11] Patent Number: 5,445,545

[45] Date of Patent: Aug. 29, 1995

[54] SHROUDED ELECTRIC OUTBOARD MOTOR

[76] Inventor: Randal K. Draper, P.O. Box 10123, Lahaina, Hi. 96761

[21] Appl. No.: 320,939

[22] Filed: Oct. 11, 1994

[51] Int. Cl.[6] ..... B60L 11/02

[52] U.S. Cl. ..... 440/6; 440/76; 440/66

[58] Field of Search ..... 440/6, 4, 7, 49, 53, 440/66, 67, 68, 75, 80, 76

[56] References Cited

U.S. PATENT DOCUMENTS

| | | | |
|---|---|---|---|
| 2,116,146 | 5/1938 | Gondek . | |
| 3,593,050 | 7/1971 | Ware . | |
| 3,599,168 | 8/1971 | Long . | |
| 3,957,007 | 5/1976 | Thomas . | |
| 4,092,946 | 6/1978 | Kappas | 440/6 |
| 4,099,478 | 7/1978 | Alexander | 440/6 |
| 4,789,302 | 12/1988 | Gruzling . | |
| 4,864,959 | 9/1989 | Takamizawa et al. . | |
| 4,993,977 | 2/1991 | Rodler, Jr. . | |
| 4,996,938 | 3/1991 | Cameron et al. . | |
| 5,101,128 | 3/1992 | Veronesi et al. . | |
| 5,102,359 | 4/1992 | Hinds . | |
| 5,145,428 | 9/1992 | Harrison . | |
| 5,261,842 | 11/1993 | Hinkel | 440/6 |

FOREIGN PATENT DOCUMENTS 1348243 11/1963 France .

*Primary Examiner*—Stephen Avila
*Attorney, Agent, or Firm*—Richard C. Litman

[57] ABSTRACT

The present invention relates to an aquatic propulsion system of modular construction. The system includes an electric motor and a gearbox that are removables as a unit. The electric motor and gearbox are housed in a two piece enclosure. A retaining ring threadably engages one of said pieces while engaging a flange on the other piece to secure the two pieces together. Optional struts are attached to the retaining ring that support a shroud around the system's propeller.

16 Claims, 4 Drawing Sheets

SHROUDED ELECTRIC OUTBOARD MOTOR

BACKGROUND OF THE INVENTION

1. Field of the Invention

The present invention relates to a submersible, water cooled, electric outboard motor of modular construction which allows motor power ratings and propeller drive gear ratios to be readily changed depending on the particular application. In addition the present invention allows a shroud or nozzle to be provided around the propeller at the users option.

2. Description of the Prior Art

Shrouded propellers are well known in the prior art, as are electric motors for use in aquatic propulsion systems.

U.S. Pat. No. 4,789,302, issued to Gruzling, is directed to the hydrodynamic design of propeller shrouds. U.S. Pat. No. 5,145,428, issued to Harrison, and French patent 1,348,243, show shrouds around the propellers of gasoline powered outboard motors. None of these patents teach or suggest the modular and quick disassembly features of the present invention.

U.S. Pat. No. 5,101,128, issued to Veronesi et al., shows an electric marine propulsion system having a shrouded propeller. The propulsion system of U.S. Pat. No. 5,101,128 is not directed to maintaining a watertight environment around a motor-gearbox assembly, in contrast to the present invention, because the motor windings of the propulsion system of U.S. Pat. No. 5,101,128 are designed to be immersed in water.

U.S. Pat. No. 4,864,959, issued to Takamizawa et al., U.S. Pat. No. 3,957,007, issued to Thomas, and U.S. Pat. No. 4,996,938, issued to Cameron et al., show devices for propelling a SCUBA diver through the water. None of these patents show the unique construction of the present invention which uses an O-ring seal and an internally threaded retaining ring to maintain a watertight environment around an electric motor-gearbox assembly.

U.S. Pat. No. 4,993,977, issued to Rodler, Jr., shows an electric propulsion system having a gearbox and a shrouded propeller. However in U.S. Pat. No. 4,993,977 the propeller hub acts as the gearbox housing. Therefore U.S. Pat. No. 4,993,977 must use a complex ball bearing based arrangement for retaining the propeller hub about the gearbox. U.S. Pat. No. 4,993,977 does not teach or suggest the unique construction of the present invention which uses an O-ring seal and an internally threaded retaining ring to maintain a watertight environment around an electric motor-gearbox assembly.

U.S. Pat. No. 5,102,359, issued to Hinds, shows a conventional electric trolling motor with two flanking plates installed on either side of the propeller to; enhance the steering ability of the electric trolling motor. U.S. Pat. No. 3,599,168, issued to Long, U.S. Pat. No. 3,593,050, issued to Ware, and U.S. Pat. No. 2,116,146, issued to Gondek, show conventional electric trolling motors. None of these patents show the unique construction of the present invention which uses an O-ring seal and an internally threaded retaining ring to hold the aquatic propulsion assembly together.

None of the above inventions and patents, taken either singly or in combination, is seen to describe the instant invention as claimed.

SUMMARY OF THE INVENTION

In the prior art the use of shrouded propellers is well known. However such propeller shrouds suffer the drawback that the shrouds are efficient only at a certain range of water craft speeds. In addition prior art propulsion systems do not provide for quick and easy replacement of motor and gearbox components. Further, the prior art propulsion systems must; use expensive motor and gearbox components specifically made for the marine environment. The prior art propulsion systems also suffer from the drawback that they do not allow quick and easy selection of motor power outputs and gear ratios depending on the particular application.

Accordingly, it is a principal object of the invention to provide an aquatic propulsion assembly of modular construction which allows quick and easy replacement of the motor and gearbox with motors and gearboxes of different power ratings and gear ratios respectively.

It is another object of the invention to provide the user with the option of either using or not using a shroud or nozzle around the propeller.

It is a further object of the invention to allow the application of inexpensive general purpose electric motors and gearboxes to marine environments.

Still another object of the invention is to allow the quick and easy replacement of damaged or defective motor and gearbox components with a minimum of down time.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
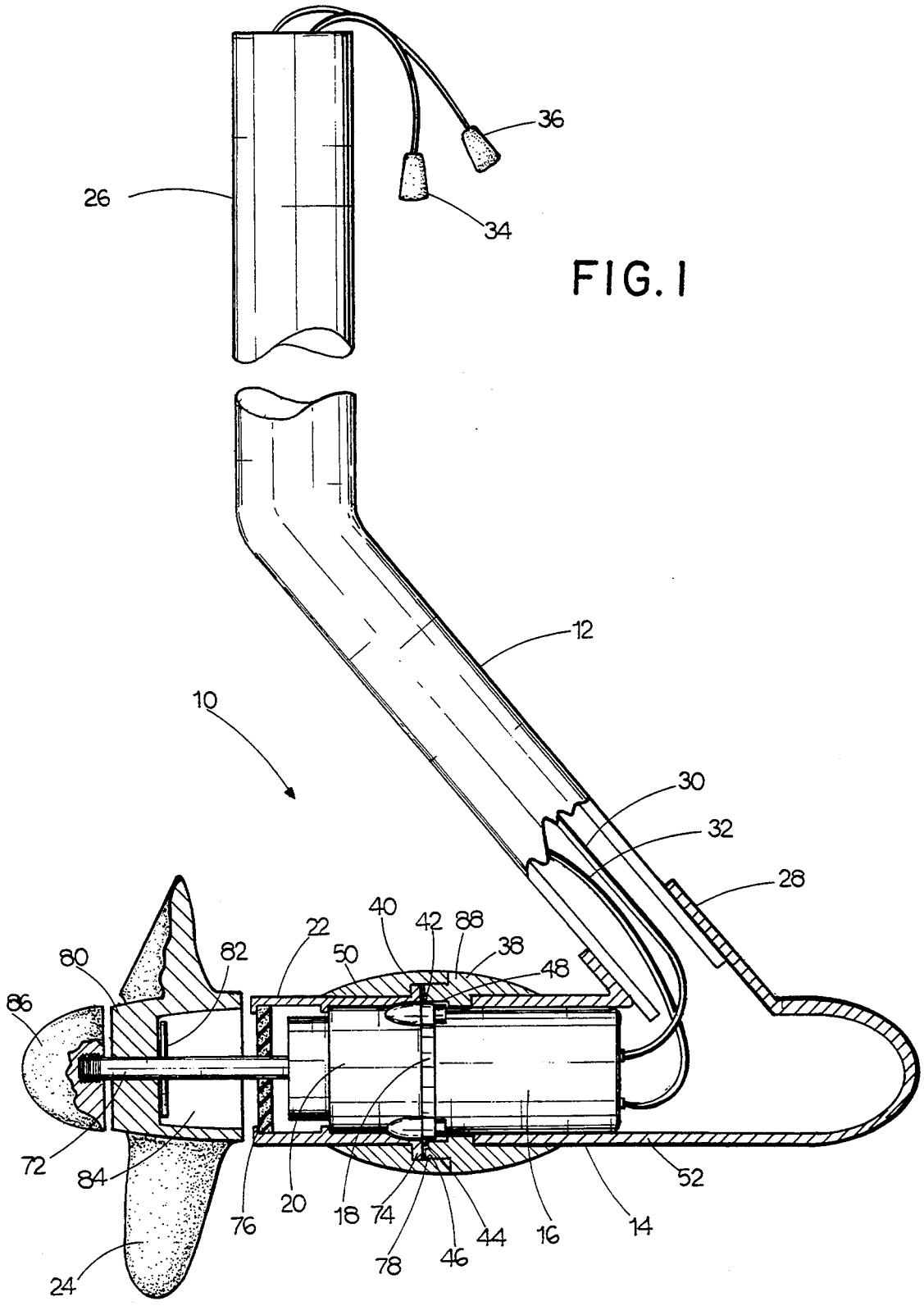
FIG. 1 is perspective view of the aquatic propulsion assembly of the present invention partially broken away to reveal internal detail.

Referring to FIG. 1, the present invention is an aquatic propulsion assembly 10 useful in a variety of applications including use as an electric outboard motor for boats, as either a primary or a secondary propulsion means, and propelling aquascooters of the type used by SCUBA divers.

The major components of the aquatic propulsion assembly 10 include a steering shaft 12; a motor housing 14; a motor-gearbox assembly including an electric motor 16, mounting plate 18, and gearbox 20; a gearbox housing 22; and propeller 24.

The steering shaft 12 is in the form of a hollow rigid tube made of a material strong enough to sustain the torques required to cause the aquatic propulsion assembly 10 to pivot in the water. Suitable materials for the steering shaft include steel, aluminum, and plastic.

The steering shaft 12 has first and second ends, hereinafter referred to as the steering shaft first end and the steering shaft second end, respectively. Proximate the steering shaft first end is a mounting portion 26 for mounting the aquatic propulsion assembly to a water craft. The attachment of the aquatic propulsion assembly to a water craft can be achieved in any well known manner and is therefore not shown in the Figures. The aquatic propulsion assembly is pivoted about the longitudinal axis of the mounting portion 26 of the steering shaft 12 in order to vector the propeller thrust, and effect the steering of the water craft.

The steering shaft second end is attached to the motor housing 14 by insertion into a tubular extention 28. The steering shaft 12 may be fixed to the tubular extention 28 in any conventional manner such as by press fitting or by using adhesives, so long as a watertight seal is maintained between the shaft 12 and the motor housing 14.

The insertion point of the steering shaft 12 into the motor housing 14 is at the end of the motor housing 14 distal from the propeller 24. This arrangement is necessitated because in this specific example the power supply connections (not shown) of the electric motor 16 are located at the end distal from the propeller 24. This location for motor power supply connections is the one most commonly encountered in off-the-shelf motors, the use of which the present invention has as one of its objects.

As can be seen from FIG. 1, the steering shaft 12 is angled toward the propeller 24. This arrangement places the longitudinal axis of the mounting portion 26 closer to the propeller 24, thus reducing the torque required to pivot the aquatic propulsion assembly 10. The hollow interior of the steering shaft 12 is in communication with the interior of the motor housing 14 to allow passage of power supply conductors 30 and 32 into the motor housing. The power supply conductors 30 and 32 terminate, near the mounting portion of the steering shaft, in connectors 34 and 36 which can be connected to for example a 12 volt battery or a solar panel, via a speed controller, in the manner well known in the art.

The motor housing 14 is in the form of a hollow cylinder having first and second ends. The first end of the motor housing has an opening having the same diameter as the internal diameter of the motor housing itself. The motor housing also includes a fitting 38 provided at the first end of the motor housing. The fitting 38 has a flat annular portion 40 disposed about the perimeter of the opening at the first end of the motor housing. An O-ring groove 42, concentric with the opening in the first end of the motor housing, is provided in the flat annular portion 40 of the fitting 38. An O-ring 44 is partially embedded in the O-ring groove 42. The fitting 38 is also provided with external threads 46 and recesses 48. The recesses 48 are provided to accomodate the fastener heads and the bosses on the mounting plate 18 which will be discussed below. The recesses 48 are located in the space between the O-ring groove 42 and the opening at the first end of the motor housing. The external threads 46 are provided for receiving a retaining ring 50 which will also be discussed below.

The second end of the motor housing 14 terminates in an ogive shape in order to reduce drag as the aquatic propulsion assembly 10 moves through the water. Also at the second end of the motor housing is the tubular extension 28 with an opening for receiving the second end of the steering shaft 12.

The internal diameter of the motor housing 14 is only slightly larger than the external diameter of the electric motor 16 in order to provide a snug fit between the motor housing and the electric motor. The fit between the electric motor 16 and the motor housing 14 is preferably snug enough to allow removal and insertion of the electric motor while maximizing the contact between the electric motor and the motor housing wall 52. The increased contact between the electric motor and the motor housing wall enhances the cooling of the electric motor by enhancing heat conduction through the motor housing wall and to the surrounding water. The motor housing wall is preferably made of aluminum, because the high thermal conductivity of aluminum desirably enhances the cooling of the electric motor.

Figure 2:
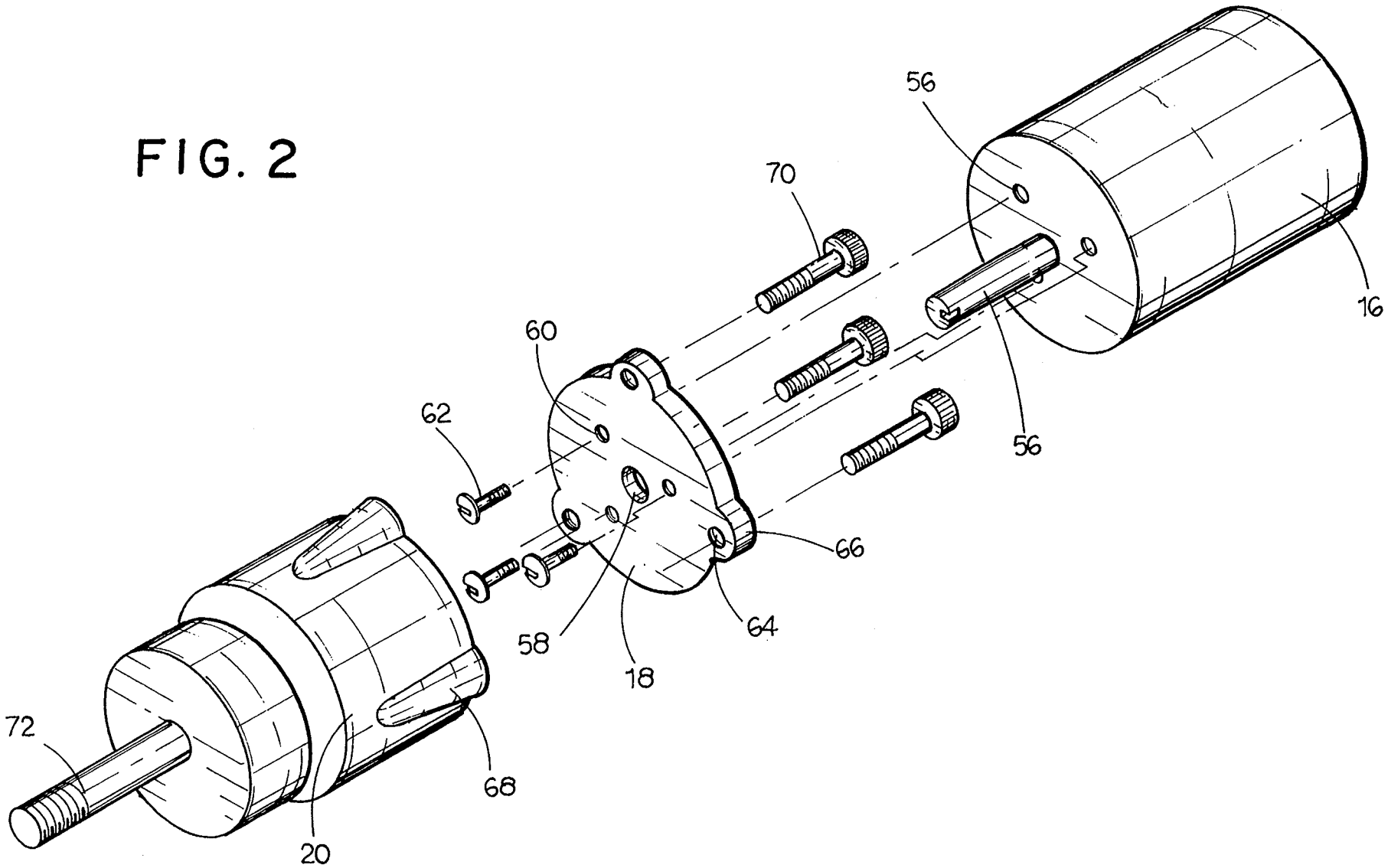
FIG. 2 is an exploded view of the motor-gearbox assembly.

The electric motor 16 is a self-contained unit having all of its windings and other components housed within its own casing. Referring to FIG. 2, the motor 16 has power supply connections (not shown), an output shaft 54, and threaded holes 56 distributed evenly about the output shaft 54.

The mounting plate 18 has a centrally located hole 58 for allowing the output shaft 54 to pass therethrough. The mounting plate 18 further has holes 60 distributed evenly about the central hole 58 that register with the, threaded holes 56 of the electric motor when the mounting plate is in the assembled position. Threaded fasteners 62 pass through holes 60 and engage threaded holes 56 in order to secure the mounting plate 18 to the motor 16. The mounting plate 18 also has bosses 66 evenly distributed about its perimeter. Each boss is provided with a through hole 64.

The gearbox 20 has an opening (not shown) in its rear to receive the output shaft from the electric motor. Bosses 68 are provided about the perimeter of the rear end of the gearbox 20. Each boss 68 is provided with a threaded hole (not shown) that registers with a corresponding through hole 64 in mounting plate 18. Threaded fasteners 70 pass through holes 64 and engage threaded holes provided in the bosses 68 in order to secure the gearbox to the mounting plate 18, thus forming the motor-gearbox assembly. A propeller shaft 72 protrudes from the front end of the gearbox 20. The gearbox is preferably of the planetary gear type and serves to reduce the propeller shaft rpm relative to the motor output shaft rpm. The threaded fasteners 62 and 70 are preferably of the allen head type.

Again referring to FIG. 1, a gearbox housing 22 having first and second ends is shown. The first end of the gearbox housing is provided with an opening and a flange 74 around the perimeter of the opening. The gearbox housing 22 fits over the gearbox 20 with the flange 74 contacting the O-ring 44 along the entire length of the O-ring 44. The second end of the gearbox housing 22 is provided with a water tight shaft seal 76 which allows the propeller shaft 72 to pass therethrough while preventing water from seeping around the propeller shaft and into the gearbox housing.

A retaining ring 50 fits over the flange 74 and has internal threads 78 which matingly engage the external threads 46 of the fitting 38. By tightening down the retaining ring 50 on the fitting 38, the O-ring 44 is compressed between the O-ring groove 42 and the flange 74 in order to provide a water tight seal between the motor housing 14 and the gearbox housing 22.

The propeller shaft 72 engages the propeller 24 via a well known pin drive mechanism. A pin 82 passes through a hole bored transversly through the propeller shaft 72. The pin 82 then fits into a mating slot 84 provided in the propeller hub 80. The propeller 24 is retained in place by the hub nut 86 which engages a threaded portion of the propeller shaft 72. A raised portion 88 is provided in the fitting 38 in order to streamline the aquatic propulsion assembly 10.

Figure 3:
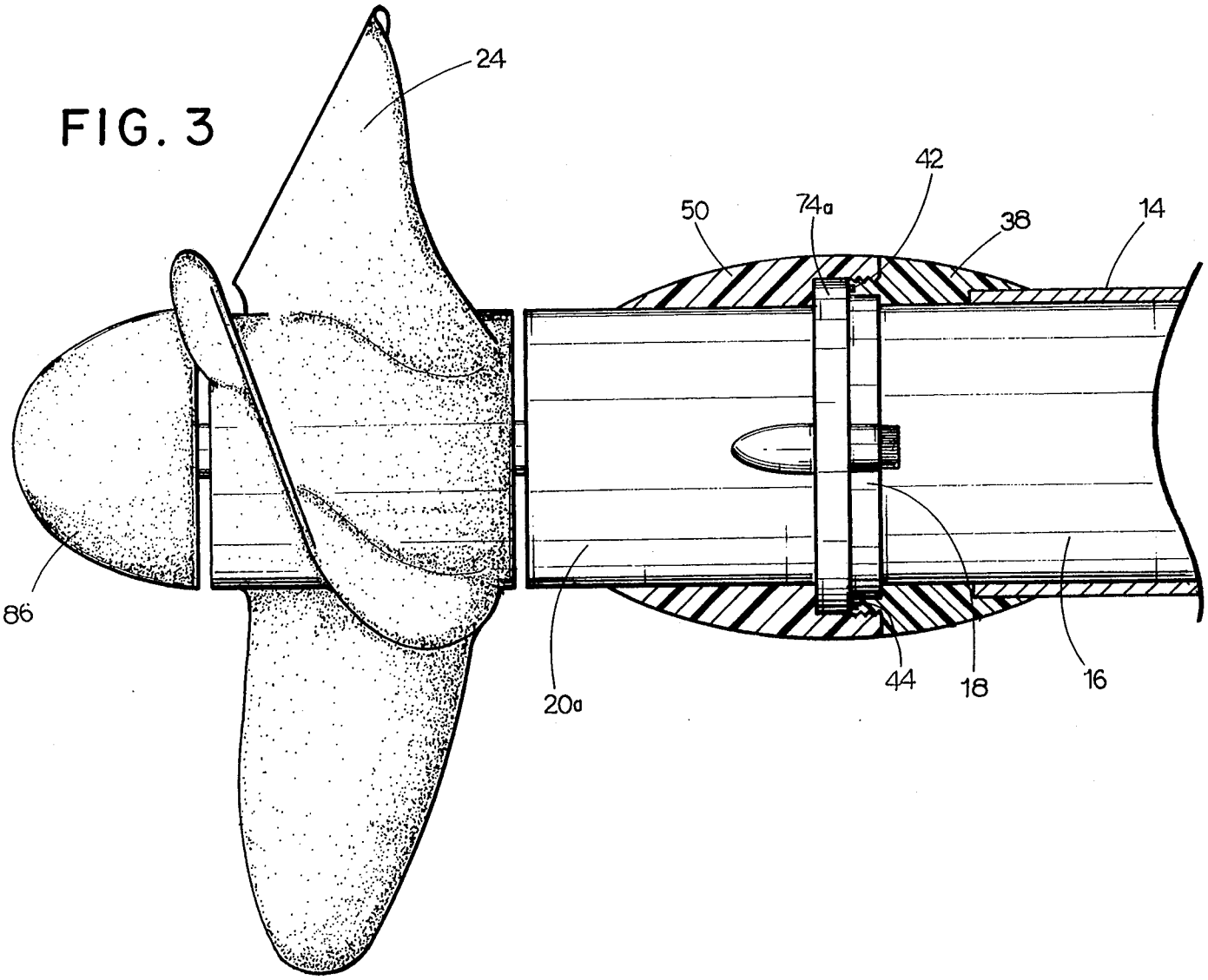
FIG. 3 is a side elevational view of the second embodiment of the aquatic propulsion assembly of the present invention partially broken away to reveal internal detail.

FIG. 3 shows a second embodiment of the present invention. The gearbox 20*a* has a built-in propeller shaft seal (not shown) thus obviating the need for the gearbox housing 22. A flange 74*a* is provided integral with the gearbox 20*a*, and functions in the same manner as flange 74 in the embodiment of FIG. 1.

The modular construction of the aquatic propulsion assembly of the present invention allows the electric motor and the gearbox to be replaced quickly and easily. Replacement of the motor and/or gearbox may be necessary either to replace a broken motor and/or gearbox, or to replace the motor and/or the gearbox with a motor of a different power rating and/or a gearbox of a different reduction ratio respectively. The replacement can be easily accomplished by first unscrewing the propeller hub nut 86, sliding the propeller 24 off the propeller shaft 72, removing the pin 82, unscrewing and sliding off the retaining ring 50 (or 50*a*), and removing the gearbox housing 22. The step of removing the gear box housing of course does not apply to the embodiment of FIG. 3. The motor-gearbox assembly can then be removed from the motor housing as one unit. Once the motor is removed from the motor housing the wires 30 and 32 can be disconnected.

Figure 4:
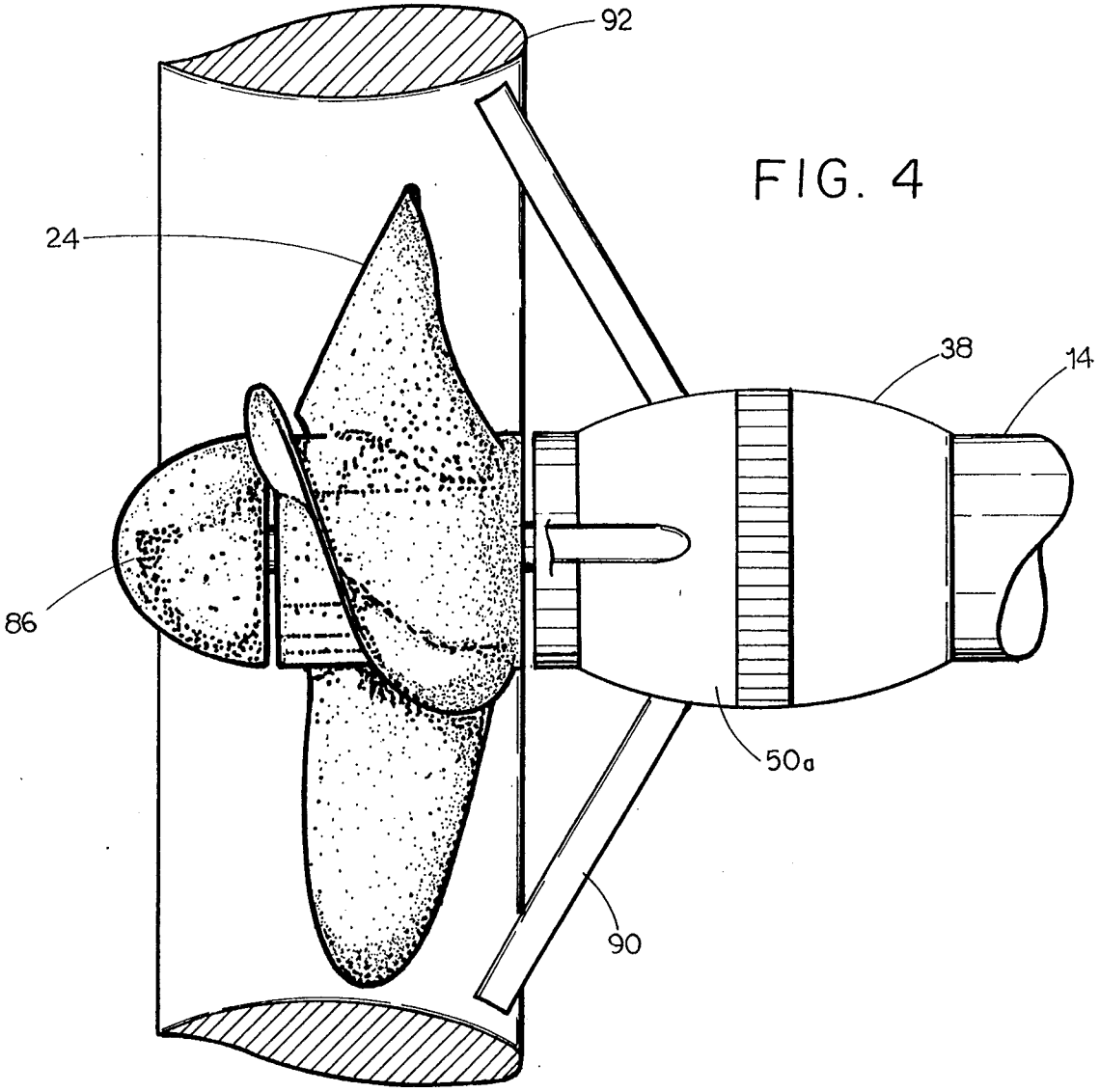
FIG. 4 is a side elevational view of the aquatic propulsion assembly of the present invention showing the propeller shroud in place.

FIG. 4 shows another beneficial aspect of the modular construction of the present invention. In applications where it is necessary to achieve greater propeller thrust at low speeds, it is desirable to provide a shroud or nozzle around the propeller. With the aquatic propulsion assembly of the present invention, a shroud or nozzle can be provided around the propeller at the option of the user by simply replacing retaining ring 50 with retaining ring 50*a*. The retaining ring 50*a* is additionally provided with the struts 90 which support the shroud 92 around the propeller 24. The retaining ring 50*a* otherwise functions in exactly the same manner as the retaining ring 50.

It is to be understood that the present invention is not limited to the embodiments described above, but encompasses any and all embodiments within the scope of the following claims.

I claim:

1. A modular aquatic propulsion assembly comprising:

a cylindrical motor housing including, a first opening leading to an interior cavity of said motor housing, and a second opening for receiving power supply conductors;

a motor-gearbox assembly including, a self-contained electric motor having a proximal end and a distal end, said proximal end including a shaft and said distal end including terminals for connecting to the power supply conductors, a self-contained gearbox having a first end connectable to said electric motor and a second end having a propeller shaft protruding therefrom, and connection means for attaching said self-contained motor to said self-contained gearbox, said motor-gearbox assembly removably inserted into said motor housing through said first opening;

a gearbox housing separable from said motor-gearbox assembly, said gearbox housing having a shaft opening to allow said propeller shaft to pass therethrough;

attachment means for sealingly securing said gearbox housing to said motor housing, whereby said motor-gearbox assembly is fully enclosed by said motor housing and said gearbox housing; and a propeller attached to said propeller shaft.

2. The aquatic propulsion assembly according to claim 1, further including:

a shroud concentrically encircling said propeller.

3. The aquatic propulsion assembly according to claim 1, wherein said connection means comprises a mounting plate secured to said proximal end of said electric motor, said mounting plate having a plurality of holes disposed about its periphery; and said first end of said gearbox including a plurality of bosses about its periphery corresponding in number to said plurality of holes disposed about the periphery of said mounting plate, each of said bosses being provided with a threaded hole, said gear box being secured to said mounting plate by fasteners passing through said plurality of holes and engaging said plurality of bosses.

4. The aquatic propulsion assembly according to claim 1, wherein said attachment means comprises a fitting disposed about said first opening of said motor housing.

5. The aquatic propulsion assembly according to claim 4, wherein said gearbox housing further includes:

a second opening in registry with said shaft opening; and a flange disposed about said second opening of said gearbox housing and sealingly contacting said fitting.

6. The aquatic propulsion assembly according to claim 5, further including:

a retaining ring engaging said flange and said fitting to secure said gearbox housing to said motor housing.

7. The aquatic propulsion assembly according to claim 6, wherein an O-ring groove and an O-ring partially embedded therein are provided, concentrically with said first opening of said motor housing, in said fitting, and said retaining ring acts to compress said O-ring between said fitting and said flange.

8. The aquatic propulsion assembly according to claim 6, wherein said connection means comprises a mounting plate secured to said proximal end of said electric motor, said mounting plate having a plurality of holes disposed about its periphery; and said first end of said gearbox including a plurality of bosses about its periphery corresponding in number to said plurality of holes disposed about the periphery of said mounting plate, each of said bosses being provided with a threaded hole, said gear box being secured to said mounting plate by fasteners passing through said plurality of holes and engaging said plurality of bosses.

9. The aquatic propulsion assembly according to claim 6, further including:

a shroud concentrically encircling said propeller; and a plurality of struts extending between said retaining ring and said shroud.

10. A modular aquatic propulsion assembly comprising:

a motor housing comprising, a first opening leading to an interior cavity, and a fitting disposed about said first opening;

a motor-gearbox assembly, at least a portion of which is removably inserted through said first opening of said motor housing and into said interior cavity, said motor-gearbox assembly having a propeller shaft projecting therefrom, said motor-gearbox assembly including a flange sealingly contacting said fitting;

a retaining ring engaging said flange and said fitting to secure said motor-gearbox assembly to said motor housing; and a propeller attached to said propeller shaft.

11. The aquatic propulsion assembly according to claim 10, further including:

a shroud concentrically encircling said propeller.

12. The aquatic propulsion assembly according to claim 10, wherein said motor-gearbox assembly comprises:

an electric motor having a shaft and being in the form of a self contained unit and having terminals for receiving power supply conductors;

a mounting plate secured to the end of said electric motor having the motor shaft protruding therefrom, said mounting plate having a plurality of holes disposed about its periphery;

a gearbox having first and second ends, said gearbox having a plurality of bosses about the periphery of its first end corresponding in number to said plurality of holes disposed about the periphery of said mounting plate and having a propeller shaft protruding from its second end, each of said bosses being provided with a threaded hole, said gear box being secured to said mounting plate, on the side opposite said electric motor, by fasteners passing through said plurality of holes disposed about the periphery of said mounting plate and engaging said threaded holes provided in said plurality of bosses.

13. The aquatic propulsion assembly according to claim 10, wherein an O-ring groove and an O-ring partially embedded therein are provided, concentrically with said first opening of said motor housing, in said fitting, and said retaining ring acts to compress said O-ring between said fitting and said flange.

14. The aquatic propulsion assembly according to claim 10, wherein said motor-gearbox assembly comprises:

an electric motor having a shaft and being in the form of a self contained unit and having terminals for receiving power supply conductors;

mounting plate secured to the end of said electric motor having the motor shaft protruding therefrom, said mounting plate having a plurality of holes disposed about its periphery;

a gearbox having first and second ends, said gearbox having a plurality of bosses about the periphery of its first end corresponding in number to said plurality of holes disposed about the periphery of said mounting plate and having a propeller shaft protruding from its second end, each of said bosses being provided with a threaded hole, said gear box being secured to said mounting plate, on the side opposite said electric motor, by fasteners passing through said plurality of holes disposed about the periphery of said mounting plate and engaging said threaded holes provided in said plurality of bosses.

15. The aquatic propulsion assembly according to claim 14, wherein said flange is provided at about the first end of said gearbox.

16. The aquatic propulsion assembly according to claim 10, further including:

a shroud concentrically encircling said propeller; and a plurality of struts extending between said retaining ring and said shroud.

* * * * *